United States Patent [19]

Mirhej

[11] 4,025,595

[45] May 24, 1977

[54] PROCESS FOR PREPARING MIXED FILAMENT YARNS

[75] Inventor: Michael E. Mirhej, Signal Mountain, Tenn.

[73] Assignee: E. I. Du Pont de Nemours and Company, Wilmington, Del.

[22] Filed: Oct. 15, 1975

[21] Appl. No.: 622,754

[52] U.S. Cl. ..... 264/103; 28/72.12; 264/210 F

[51] Int. Cl.[2] ..... D01D 5/12

[58] Field of Search ..... 264/210 F, 103; 28/72.12

[56] References Cited

UNITED STATES PATENTS

| | | | |
|---|---|---|---|
| 3,593,513 | 7/1971 | Reese | 57/140 BY |
| 3,681,910 | 8/1972 | Reese | 57/140 BY |
| 3,803,282 | 4/1974 | Hamana et al. | 264/103 |

*Primary Examiner*—Jay H. Woo

[57] ABSTRACT

Continuous, mixed filament yarns are provided as well as a process for preparing them in which at least two different continuous filament yarns are cospun and separately entangled; the entangled yarns are consolidated and drawn to yield from 0.5–6 entanglements/meter in the consolidated yarn after drawing, and the drawn yarn is intermingled to yield a product yarn having a degree of filament intermingling of 45–80%, a denier of 70–260 and 20–68 filaments.

12 Claims, 4 Drawing Figures

PROCESS FOR PREPARING MIXED FILAMENT YARNS

BACKGROUND OF THE INVENTION

This invention relates to synthetic organic continuous filament yarns of mixed filament types and to a process for preparing them.

Yarns composed of different types of filaments are generally known. For example, groups of different colored filaments have been plied together to form a composite yarn as have filaments having different dye affinities. Fabrics prepared from such yarns have a characteristically mottled or blotchy appearance referred to as "heather". Similarly, yarns composed of plied fibers having different luster or shrinkage characteristics have been disclosed in the art.

Various techniques are known for combining mixtures of filaments. These techniques utilize jets, stuffer box crimpers, real twist and false twist methods and the like and combinations thereof. U.S. Pat. No. 3,593,513 issued July 20, 1971 to Reese even describes the production of a yarn by cospinning. A fabric is produced which has a fine heather appearance. The process provides groups of filaments having dissimilar inherent apparent coloration intermingled into a unitary integral yarn as a result of combining the filaments prior to completion of the drawing operation.

However, each of such tecnhiques provides yarns from which fabrics having only a narrow range of mixed filament effects can be produced. One such effect is directionality or streakiness in which the effect of each different filament characteristic is seen flowing into that of the other filament or filaments present. Another such effect is contrast in which the cut-off between the characteristics of each filament type present can range from sharp to ill-defined. In today's marketplace where fashion and styling changes from day to day, it would be advantageous if a single process could be utilized to provide yarns which, in turn, will provide the wide spectrum of mixed filament effects in fabrics, particularly with regard to contrast and directionality.

SUMMARY OF THE INVENTION

It has now been found that a range of continuous mixed filament texturing feed yarns which will provide a range of fabrics having advantageous mixed filament characteristics can be prepared in a single process when at least two different continuous filament yarns are cospun and separately entangled. The entangled yarns are consolidated and drawn to yield from 0.5–6 entanglements/meter in the consolidated yarn after drawing. The drawn yarn is then intermingled to achieve a product yarn having a degree of filament intermingling (dfi) of 45–80%, a denier of 70–260 and 20–68 filaments. The process provides yarns which will produce a whole spectrum of mixed filament effects in a fabric, ranging from high contrast/high directionality to low contrast/low directionality.

DRAWINGS

DETAILED DESCRIPTION OF THE INVENTION

Figure 1:
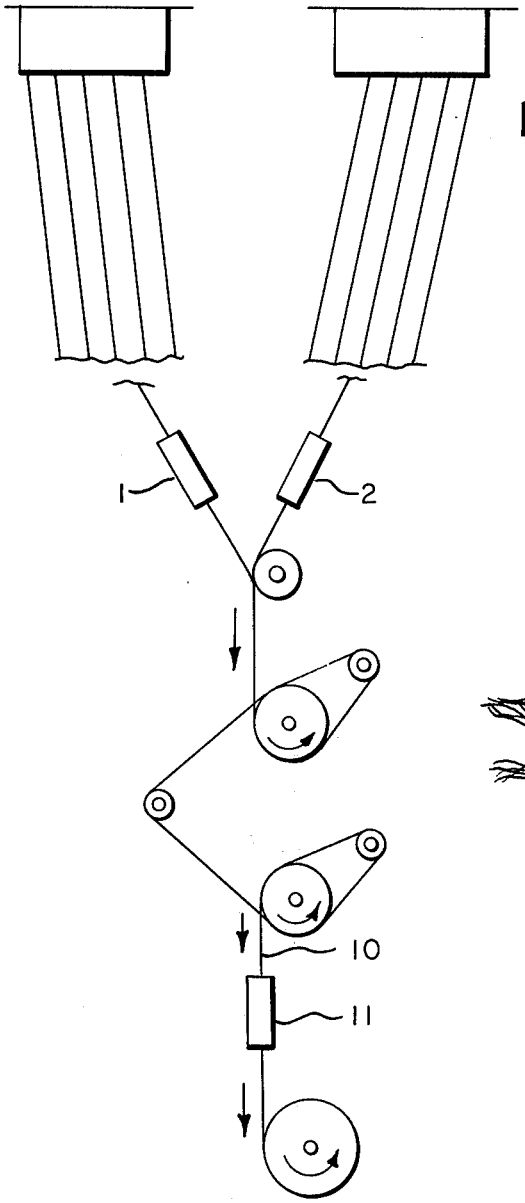
FIG. 1 is a schematic representation of one method for carrying out the process.
Figure 2A:
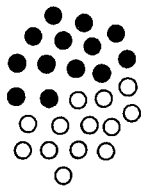
FIG. 2A is a cross-section of an intermingled yarn which will provide high contrast (low dfi).
Figure 2B:
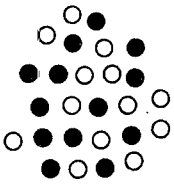
FIG. 2B is a cross-section of an intermingled yarn which will provide low contrast (high dfi).
Figure 3:
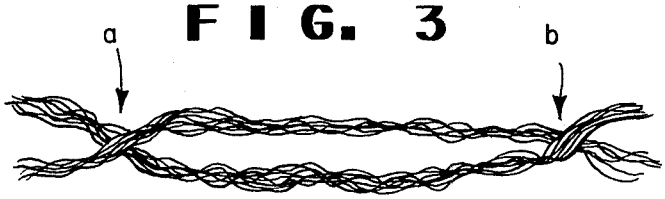
FIG. 3 is a schematic representation of a yarn of this invention having low dfi which gives high contrast in fabrics. *a* and *b* are cross-over points the distance between which determines the level of directionality in a fabric knit therefrom.

The process of this invention can be used to prepare a whole range of continuous filament yarns having mixed properties such as color, cross-section and so on. The mixed properties derive from cospinning one or more bundles of filaments of different cross-section or from different polymers or from the same polymer but with different delustrants or from polymers which have a different dyeability, color or shade of the same color and so on. While it might be expected that entangling the component bundles before drawing might result in filament breakage with an attendant decrease in tenacity and overall yarn strength, surprisingly, such is not the case. Substantially no filament breakage occurs in the yarns upon drawing during the process of this invention. The different filament bundles can be cospun using any suitable equipment that will permit separate compartments containing polymer melt to be fed to single or side-by-side spinnerettes. The spinnerette holes may have any desired geometry, such as, for example, those disclosed in U.S. Pat. Nos. 2,939,201; 3,691,749 and the like.

Any suitable homo- and/or copolymers having different dyeability or containing different additives, such as delustrants and the like can be used in the process of this invention. When different polymers are used, the shrinkage between the polymers should differ by a maximum of 2%, preferably less, in order to insure the substantially straight line relationship in the range of effects from high contrast/high directionality to low contrast/low directionality made possible by this invention. Some suitable homo- and/or copolymers which may be used include, for example, poly(ethylene terephthalate), poly[ethylene terephthalate/(5-sodium sulfo)isophthalate], polyhexamethylene adipamide, polyhexamethylene adipamide containing sulfo or amino groups receptive to cationic or dark acid dyes respectively and the like and mixtures thereof. The filaments may have non-round or different cross-sections as disclosed in U.S. Pat. No. 2,939,201 issued to Holland and/or hexalobal, octalobal and the like cross-sections, in which case fabrics prepared from them will have sparkle or subtle, lustrous appearances.

For textile or apparel end uses, the continuous filament yarns to be processed by this invention must contain about 20–68 filaments, preferably about 34, and have a denier of about 70–260, preferably about 150. The yarns can contain mixed denier filaments and three or more components as long as the denier of the yarn remains within the above range.

The bundles of each cospun component are kept separate and each is separately entangled before being drawn in order to insure the desired contrast and directionality for each filament effect in a fabric. The highest degree of contrast is achieved at the highest number of entanglements in each component bundle.

Entanglements can be induced by passing each component through an interlacing jet as disclosed in U.S. Pat. Nos. 3,364,537; 3,426,406; 3,115,691 or the like, or in any other suitable manner. The bundles are consolidated or placed together with one another after each bundle is entandled and the consolidation is drawn.

The entangled components can be consolidated in any suitable manner and then drawn in any suitable manner such as, for example, with a draw roll and a draw jet, a hot draw pin, a draw bath and so on. The use of a stream draw jet is preferred for ease of operability, particularly when drawing polyesters. The yarn may be drawn at any ratio which will not result in excessive filament breakage and draw ratios in the range of 2.8–3.8 are preferred.

The drawn consolidated bundle must have from 0.5–6 entanglements per meter in order most effectively to achieve the advantages of this invention. At less than about 0.5 entanglement per meter after drawing, although the directionality in a fabric is low, the contrast is undesirably low. At greater than six entanglements per meter after drawing, although the contrast in a fabric is high, the directionality is so high that an undesirably high degree of streakiness is obtained. The number of entanglements per meter can be measured by the pin count test described in U.S. Pat. No. 3,290,932. The number of pin deflections is measured per meter of running yarn at a running tension of 17 grams and a total pin deflection tension of 22 grams during a pin count test made on the yarn after it passes through the draw stage. The number used is an average of twenty measurements. While the manner and ratio of drawing have some effect on the number of entanglements retained in the component filaments, this effect is irrelevant since the entanglement indices are determined after the yarn passes through the drawing stage.

After the consolidated yarn is drawn, it is intermingled to achieved a dfi of 45–80%. The intermingling can be achieved by passing the drawn, consolidated yarn through a torque jet or an interlacing jet, including those described in the patents listed above, or in any other suitable manner which will intermingle the components of the different but consolidated filament bundles with one another. Jets such as those used to entangle the separate bundles can also be used in this step, except that the jet pressures should be higher in order to achieve a dfi of 45–80% measured as described in U.S. Pat. No. 3,593,513.

The characteristics of the yarn produced can be varied by balancing the number of entanglements after drawing with the degree of intermingling to achieve the desired dfi. For example, a 150-denier/34-filament yarn, the component bundles of which have up to 0.8 entanglements/meter after drawing, which is intermingled to a dfi of 75–80% will give a yarn providing low contrast/low directionality in fabrics. A yarn having 0.9–2 entanglements per meter after drawing and intermingled to a dfi of 64–74% provides medium contrast/medium directionality in fabrics. Yarn entangled to above 2 entanglements/meter after drawing and intermingled to a dfi of $\leq$ 63% provides a fabric with high contrast and high directionality.

The yarns produced by the process of this invention are eminently suitable as texturing feed yarns. Any of the false twist texturing or set texturing procedures conventionally employed in processing yarns can be employed with yarns made by the process of this invention.

The invention is further illustrated but is not intended to be limited by the following examples in which all parts and percentages are by weight unless otherwise specified. Contrast in the examples is determined by dfi and confirmed by subjective analysis. Directionality is determined on fabric made by the Lawson-Hemphill fiber analysis knitter with a 3.5 inch head using a single end of textured yarn of 160 or 117 denier and dyeing with three cationic dyes as in the examples and described in U.S. Pat. No. 3,772,872. Fabrics having average streak lengths of 0.5–1.5 cm have low directionality; fabrics having average streak lengths of 1.6–3 cm have medium directionality and fabrics having average streak lengths of greater than 3 have high directionality.

EXAMPLE I

This example illustrates the general preparation of yarn in accordance with the present invention, which yarn will provide a dyed fabric having a medium contrast and directionality.

A poly(ethylene terephthalate) polymer having a reltive viscosity of 21 (as measured in U.S. Pat. No. 3,772,872, Col. 3, lines 57–65) and containing 0.3% by weight of $TiO_2$ and a poly[ethylene terephthalate/(5-sodium sulfo)isophthalate]98/2 polymer having a relative viscosity of 14.0 and containing 0.3% by weight of $TiO_2$ are separately metered to two separate inlet ports of a melt-spinning assembly, substantially similar to FIG. 1, designed to accommodate the two streams and keep them apart. The polymers are discharged at a temperature of approximately 288° C in conventional manner through 34 small round orifices of a circular spinnerette divided in half, each polymer type being extruded separately through its own half of the spinnerette. Cospinning permits the production of higher denier yarns, the use of higher draw ratios and, therefore, increased production versus the use of yarns fed to the process from packages. The two groups of filaments are kept separate and each is passed separately through an interlacing jet 1 and 2 having the structure described in U.S. Pat. No. 3,364,537 and operated at 35 psi air pressure. The separate filament groups are brought together and drawn together in a steam draw jet operated at 235° C and 70 psi steam. The combined drawn yarn 10 has two entanglements per meter as measured by a Rothschild Model R-2040 pin drop instument. Finally, the entangled yarn is interlaced with a jet 11 having the structure described in U.S. Pat. No. 3,426,406 and operated at 20 psi air pressure. The yarn is then wound up on packages at speeds in excess of 3400 ypm operated at a tension of 25–35 gms. A cross-section of the yarn shows a dfi of 66–70%. The yarn has a denier of 150, a tenacity of 3.8 gpd and 29% elongation.

The above yarn is false-twist textured on a Leesona 555 using the following conditions: heater temperature = 190° C; spindle speed = 240,000 rpm to give a twist of 60 turns per inch; bottom overfeed = 0%; top overfeed = +5%.

A Ponte-di-Roma fabric is prepared, cross-dyed with yellow disperse and black cationic dyes, heat set and finished in conventional fashion. The fabric exhibited a medium heather appearance (medium contrast and directionality).

EXAMPLES II–XI

The procedures described in Example I are followed with the modifications set out in Table 1.

TABLE 1

| | Jet[1] Air Pressure psi | Draw Jet Steam Pressure psi | Entanglements/ meter | Jet[2] Air Pressure psi | DFI % | Fabric Appearance (Heather Directionality) | Heather Contrast |
|---|---|---|---|---|---|---|---|
| II | 50 | 70 | 2.0 | 10 | 64 | Med.[4] | Med. |
| III | 20 | 85 | 1.1 | 10 | 72 | Med. | Med. |
| IV | 50 | 85 | 2.0 | 10 | 70 | Med. | Med. |
| V | 50 | 70 | 2.0 | 40 | 63 | Med. | Med. |
| VI | 50 | 85 | 2.0 | 40 | 72 | Med. | Med. |
| VII | 15 | 70 | .8 | 20 | 79 | Low[3] | Low |
| VIII | 25 | 70 | 1.3 | 20 | 76 | Med. | Med. |
| IX | 35 | 70 | 2.0 | 20 | 68 | Med. | Med. |
| X | 45 | 70 | 2.0 | 20 | 66 | Med. | Med. |
| XI | 55 | 70 | 2.0 | 20 | 64 | Med. | Med. |

[1]predraw entanglement
[2]postdraw intermingling
[3]approximate length of streaks: average = 0.7 cm.
[4]approximate length of streaks: average = 1.5 cm.

EXAMPLE XII

Using a spinneret with 20 holes, the processes of Example I were repeated with 10 filaments each of the polymers described in that example to provide a yarn having a denier of 110. The predraw interlace jet (1) described in U.S. Pat. No. 3,426,406 set at 30 psi was used. The final interlace jet (11) set at 30 psi provided a DFI of 70%. Fabrics showed medium contrast and directionality.

EXAMPLES XIII–XIX

The procedures described in Example XII are followed with the modifications set out in Table 2.

TABLE 2

| | Jet[1] Air Pressure psi | Draw Jet Steam Pressure psi | Entanglements/ meter | Jet[2] Air Pressure psi | DFI % | Fabric Appearance (Heather Directionality) | Heather Contrast |
|---|---|---|---|---|---|---|---|
| XIII | 30 | 70 | .6 | 20 | 72 | Med. | Med. |
| XIV | 30 | 70 | .6 | 40 | 67 | Med. | Med. |
| XV | 40 | 70 | (1.0) | 20 | 60 | High[5] | High |
| XVI | 40 | 70 | (1.0) | 40 | 66 | Med. | Med. |
| XVII | 50 | 70 | 1.4 | 20 | 62 | Med. | High |
| XVIII | 50 | 70 | 1.4 | 40 | 63 | Med. | High |
| XIX | 60 | 70 | — | 20 | 61 | High | High |

[1]predraw entanglement
[2]postdraw intermingling
[5]approximate length of streaks: average = greater than 3 cm.

What is claimed is:

1. A process for preparing continuous, mixed filament yarns having 20–68 filaments and a denier of 70–260 which comprises cospinning at least two different bundles of continuous filaments, separately entangling each bundle, consolidating the entangled bundles and drawing them together to yield from about 0.5–6 entanglements/meter after drawing, and then intermingling the drawn yarn to a degree of filament intermingling of about 45–80%.

2. The process of claim 1 wherein the yarn has about 34 filaments.

3. The process of claim 1 wherein the yarn has a denier of 150.

4. The process of claim 1 wherein the cospun filaments have non-round cross-sections.

5. The process of claim 1 wherein the bundles are entangled with an interlacing jet.

6. The process of claim 5 wherein the jet is operated at a pressure of 15–60 psi.

7. The process of claim 1 wherein the drawn yarn is intermingled with an interlacing jet.

8. The process of claim 7 wherein the jet is operated at a pressure of 10–40 psi.

9. The process of claim 1 wherein the yarn is drawn 2.8–3.8X.

10. The process of claim 9 wherein the consolidated bundles are drawn in a steam jet operated at a steam pressure of 70–85 psi.

11. The process of claim 1 wherein the yarn is cospun from a poly(ethylene terephthalate) polymer.

12. The process of claim 1 wherein the yarn is cospun from a poly(ethylene terephthalate) and a poly[ethylene terephthalate/(5-sodium sulfo)isophthalate]-polymer.

* * * * *